US005367854A

United States Patent [19]

Kim

[11] Patent Number: 5,367,854

[45] Date of Patent: Nov. 29, 1994

[54] METHODS FOR CONNECTION OF PRECAST CONCRETE UNITS

[76] Inventor: Sun-Ja Kim, Limchang Apt 3-508, 187-26 Cheungsan-Dong, Eunpoung-Ku, Seoul, Rep. of Korea

[21] Appl. No.: 979,545

[22] Filed: Nov. 20, 1992

[30] Foreign Application Priority Data

Nov. 23, 1991 [KR] Rep. of Korea ..... 1991-21003

[51] Int. Cl.[5] ..... E04G 21/00

[52] U.S. Cl. ..... 52/745.13; 52/259; 52/741.1; 264/27

[58] Field of Search ..... 52/250, 251, 252, 253, 52/259, 741.1, 743, 745.13, 745.18, 745.19, 745.2, 745.21, 744; 264/23, 25, 27, 228, 229, 261

[56] References Cited

U.S. PATENT DOCUMENTS

| | | | |
|---|---|---|---|
| 3,613,325 | 10/1971 | Yee | 52/259 |
| 3,645,056 | 2/1972 | Gerola | 52/259 |
| 3,867,805 | 2/1975 | Mikami et al. | 52/744 |
| 3,881,289 | 5/1975 | Mauroner | 52/259 |
| 3,948,008 | 4/1976 | Goetz | 52/251 |
| 4,019,293 | 4/1977 | Armas | 52/259 |

*Primary Examiner*—Michael Safavi
*Attorney, Agent, or Firm*—Webb Ziesenheim and Bruening

[57] ABSTRACT

A wet connection method for the precast concrete units capable of performing the connection of the units in a shorter time by electrically heating the concrete placed in the connection part. This method comprises the steps of connecting the reinforcing bars of the units to each other with a second conductive member of a conductive wire or net member in a space defined by the reinforcing bars, winding a conductive liner member around the connected reinforcing bars in order to provide a first conductive member, electrically connecting terminals of an electric power source to the first and second conductive members in such a manner that the polarities of the terminal and the conductive member are opposite to each other and applying electric power to the conductive members in order to cause the concrete placed in the connection part to be heated and rapidly cured. The present connection method shortens the curing time of the concrete and the term of work.

22 Claims, 10 Drawing Sheets

METHODS FOR CONNECTION OF PRECAST CONCRETE UNITS

BACKGROUND OF THE INVENTION

1. Field of the Invention

The present invention relates in general to methods for connection of precast concrete units in construction work, for example, connection of beam to beam, wall to wall, wall to slab, slab to slab or etc., and more particularly to wet connection methods for connecting the precast concrete units to each other in which concrete placed in the connection part between the units is electrically heated, thereby shortening the curing period and the term of work.

2. Description of the Prior Art

In recent, precast concrete units for the construction of buildings or other structures, particularly for the beams, columns, walls and slabs thereof, are efficiently utilized to simplify the site work and, in this respect, to shorten the term of works. Also, the precast concrete units generally have a sufficient strength for attaining the structural strength required to withstand handling loads and loads imposed by the structure. In order to carry out the construction of structures using such precast concrete units, the units are connected to each other. Conventionally, the methods for connection of the precast concrete units are classified into two types, that is, a dry connection method and a wet connection method.

In the typical dry connection method, a short I-beam or steel plate is partially embedded in each end of the precast concrete units in order to be bolted or welded to each other. However, this type of method has a problem in that it is relatively expensive. Furthermore, the exposed part of I-beam or steel plate used in this connection must be covered with concrete after completion of connection work for the protection against fire and corrosion, thereby inducing a problem of complex work process.

Meanwhile, FIGS. 21 and 22 show an embodiment of a typical wet connection method for beams and columns and a bending moment diagram of the frame after completion of connection, respectively. As shown in FIG. 21, in the typical wet connection method, concrete is placed into the connection parts 303, at which the precast concrete beams and columns are connected, respectively, then cured at the site temperature and this causes the next step of work not to start until the concrete placed in the connection parts 303 is sufficiently cured. In this respect, a problem of this typical wet connection method is resided in a fact that the term of work is inevitably lengthened. On the other hand, the precast concrete beams 301 are typically supported by columns 302 so that the connection part should be located on the columns, where the maximum bending moment of the frame tabes place. In result, another problem of this typical wet connection method is resided in a fact that cracks are apt to be generated at the connection part 303 and this results in a structural defect.

Steam or hot air can be used in order to shorten the curing period of the concrete-placed in the connection parts 303. However, this type of curing method has a problem in that it needs a complex and heavy equipment and the steam or the hot air can not efficiently heat all over the inside of the concrete applied to the connection parts 303, thus causing this curing method to be practically scarcely used.

Accordingly, if briefly described, the wet connection method has an advantage in that it is less expensive, from the viewpoint of the construction cost, than the dry connection method, while it inevitably has a disadvantage of the longer term of work caused by the longer curing period than the dry connection method. In this respect, it has been required to provide a noble precast concrete unit connection method which can cure the concrete placed in the connection parts in a shorter time than the known wet connection method, thus shortening the term of work.

SUMMARY OF THE INVENTION

It is, therefore, an object of the present invention to provide a method for connection of precast concrete units in which the aforementioned problems can be overcome and the connection parts, at which the units are connected to each other and in which concrete is placed respectively, are electrically heated in order to shorten the curing period of the concrete placed therein and, in this respect, the term of work is substantially shortened.

In an embodiment of the present invention, the aforementioned object can be accomplished by providing a method for connection of precast concrete units in which the connection parts, at which the units are connected to-each other and in which concrete is placed respectively, are electrically heated by means of an electric equipment in order to shorten the curing period of the concrete, thus shortening the term of work.

If in detail described, the precast concrete units connection method of the present invention comprises the steps described as follows:

Each reinforcing bar projecting from the end surface of one unit is connected to the reinforcing bar projecting from the other unit by welding or other mechanical method. Here, prior to the connection of the reinforcing bars, at least one conductive wire netting is previously disposed in the space which is defined by the reinforcing bars. Thereafter, reinforcing bars, such as stirrups, tie bars or etc., are tightly wound around the connected reinforcing bars in order to provide an outer conductive member. The inner wire netting is then forced to be spaced apart from the outer conductive member by a predetermined uniform interval, thereafter, the inner wire netting is electrically connected to a terminal of an electric power source, while the outer conductive member is electrically connected to the other terminal of the same electric power source. The connection part is then surrounded with a form and concrete is placed into the form, thereafter, electric power is applied to the conductive members of the connection part and this makes the concrete between the inner wire netting and the outer conductive member of the connection part to he heated as it becomes an electric resistant material.

BRIEF DESCRIPTION OF THE DRAWINGS

The above and other objects, features and other advantages of the present invention will be more clearly understood from the following detailed description taken in conjunction with the accompanying drawings, in which:

FIGS. 4 and 5 are views respectively showing a connection part at which reinforcing bars projecting from both units are connected to each other and provided with the wire nettings, nonconductive rods and stirrups, in which:

FIG. 4 is a side view; and

FIG. 5 is a cross sectioned view taken along the section line 5—5 of FIG. 4;

FIGS. 7 and 8 show an embodiment of a vertical connection method, such as for connection of column units to each other, in accordance with the present invention, respectively, in which:

FIG. 7 is a view showing an initial state of the vertical connection; and

FIG. 8 is a view corresponding to FIG. 7, but showing a state after being equipped at the connection part with wire nettings, tie bars and the form:

FIGS. 9 and 10 show an embodiment of a connection method for connecting a wall unit to a slab unit in accordance with the present invention, respectively, in which:

FIG. 9 is a perspective view: and

FIG. 10 is a sectioned view showing a state of the connection part prior to the last step of the present invention:

FIGS. 11 and 12 show an embodiment of a connection method for connecting wall units in accordance with the present invention, respectively, in which:

FIG. 11 is a perspective view: and

FIG. 12 is a sectioned view taken along the section line 12—12 of FIG. 11 showing a state of the connection part prior to the last step of the present invention;

FIGS. 13 to 15 show another embodiment of a horizontal connection method in accordance with the present invention for connecting a beam unit to a column unit, both units having inclined end surfaces, respectively, in which:

FIG. 13 is a view corresponding to FIG. 1;

FIG. 14 is a view corresponding to FIG. 3; and

FIG. 15 is a view corresponding to FIG. 4 only stirrups not shown:

FIGS. 16 to 18 show an embodiment of the present invention in the case that an end of a precast concrete unit is provided with reinforcing bars projecting therefrom and the facing end of counterpart unit is provided with sleeves for receiving the reinforcing bars, respectively, in which:

FIG. 16 is an elevational sectioned view:

FIG. 17 is a cross sectioned view of the connection part; and

FIG. 18 is a cross sectioned view of a sleeve and a reinforcing bar after completion of inserting;

DETAILED DESCRIPTION OF THE PREFERRED EMBODIMENTS

First of all, profiles of precast concrete units which can be connected to each other by the connection method of the present invention will be described in conjunction with the accompanying drawings 1 to 18.

Figure 7:
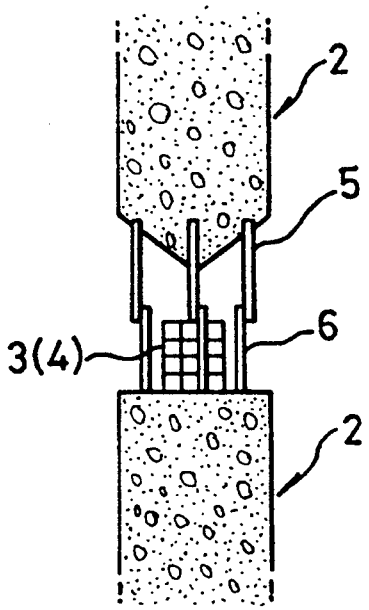
Figure 8:
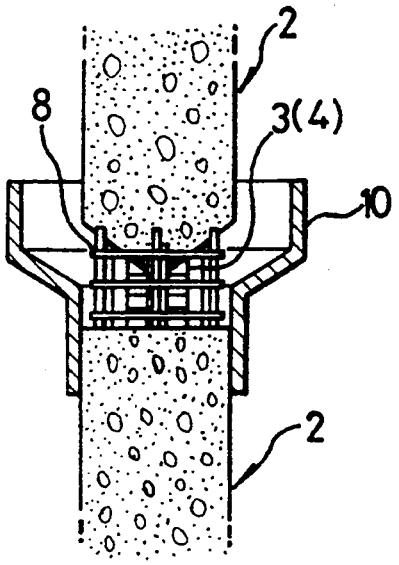
Figure 9:
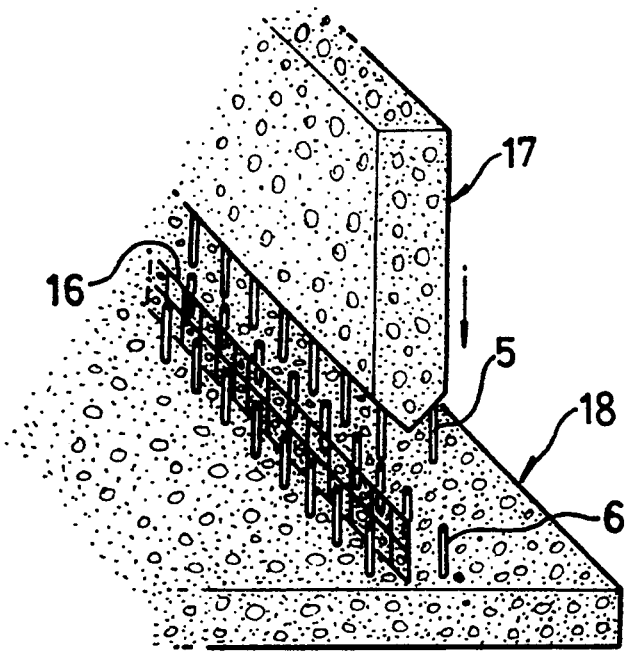
Figure 10:
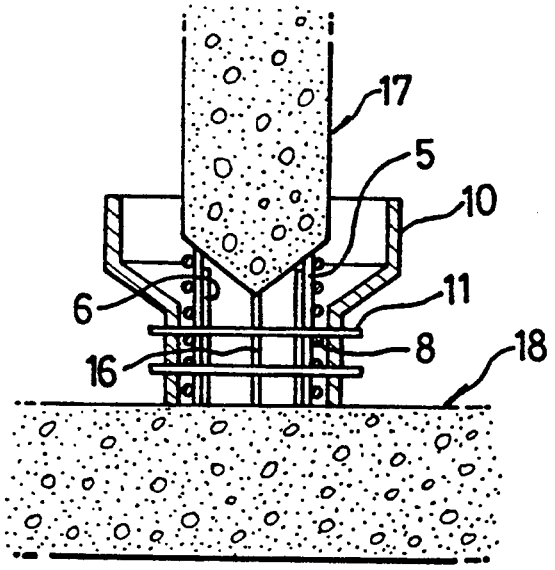
Figure 11:
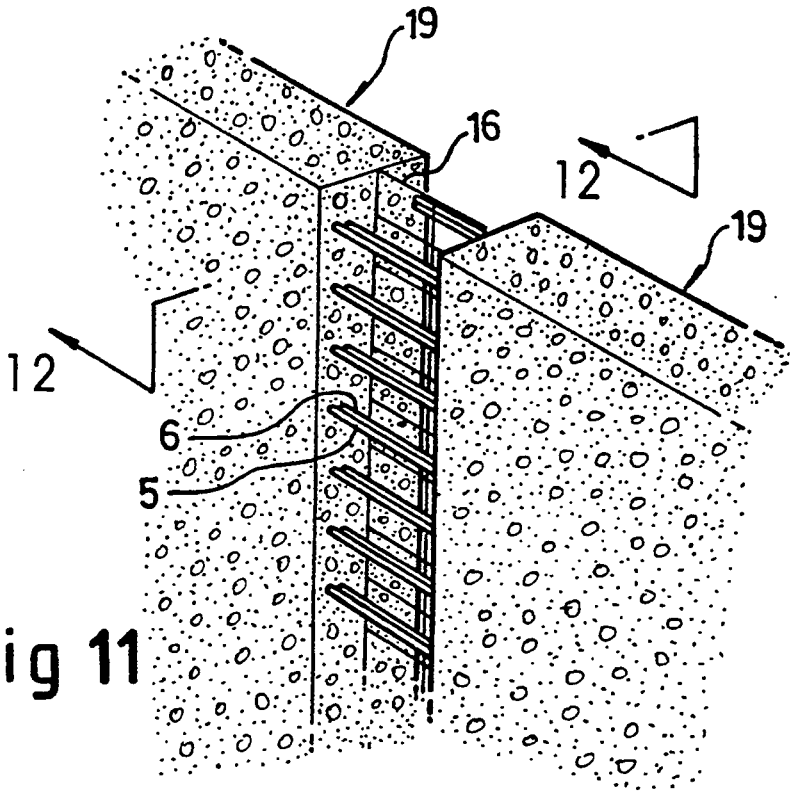
Figure 12:
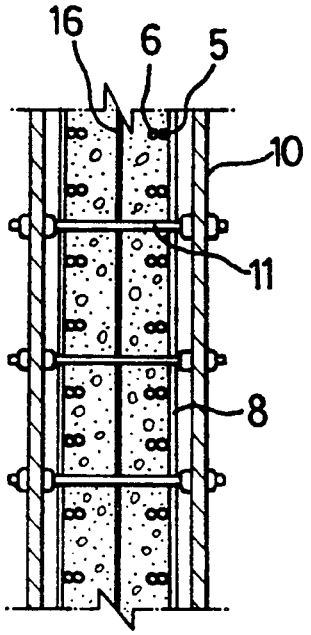
Figure 13:
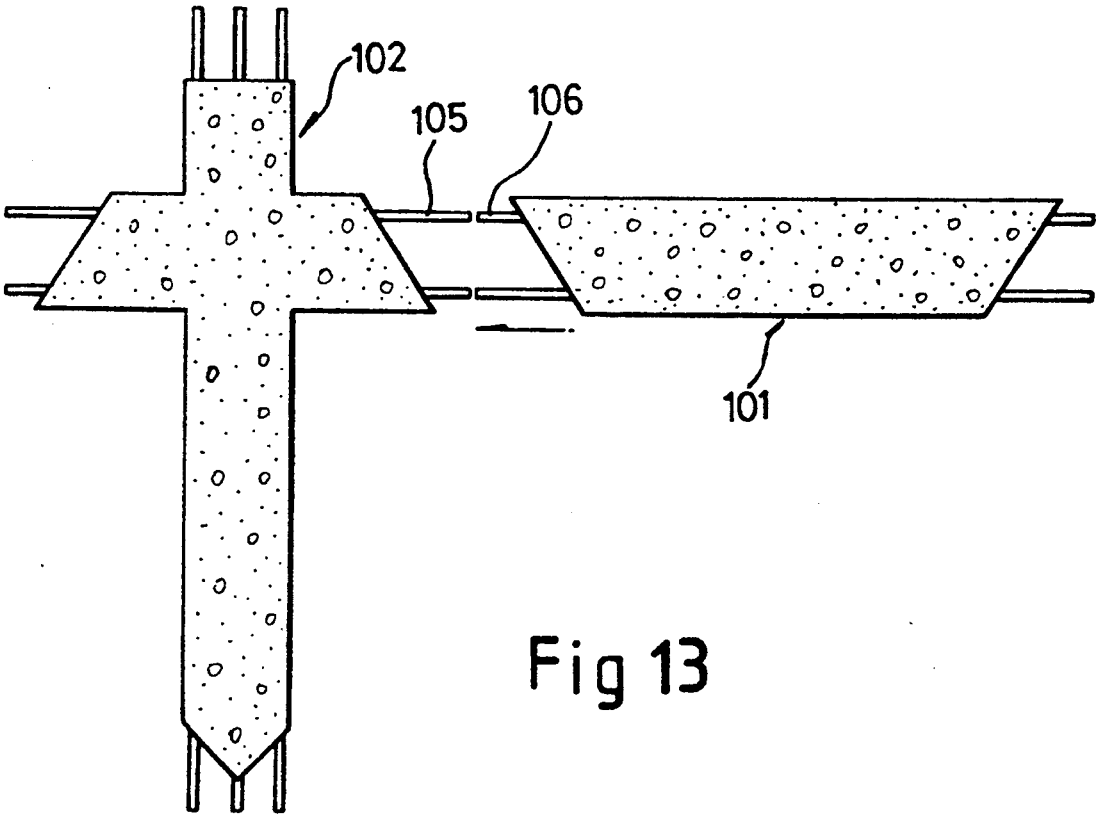
Figure 14:
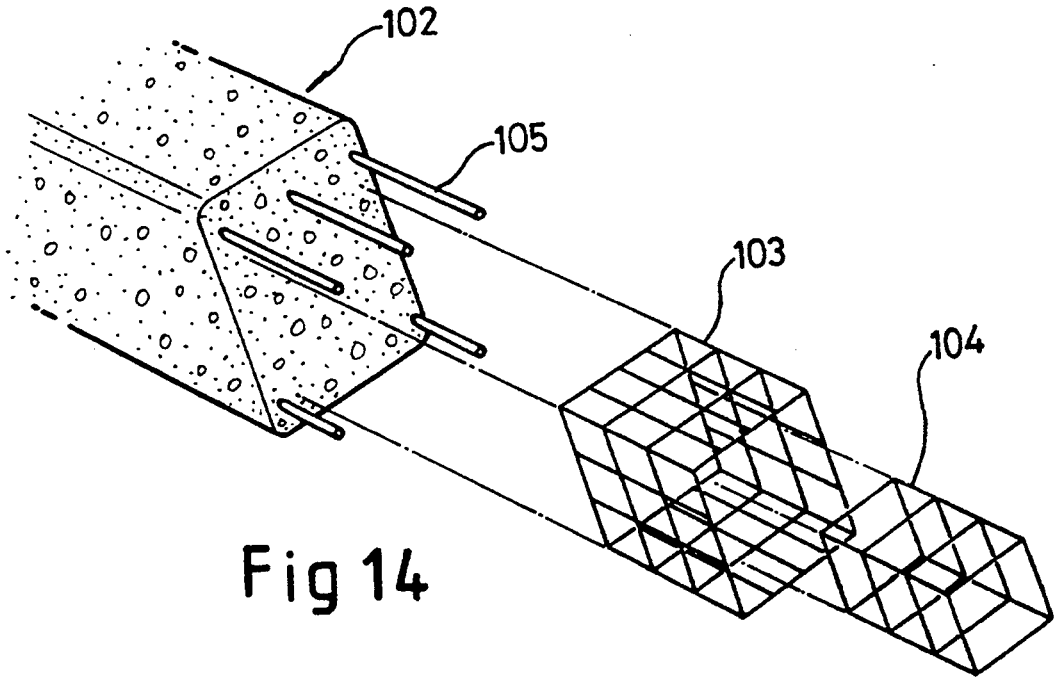
Figure 15:
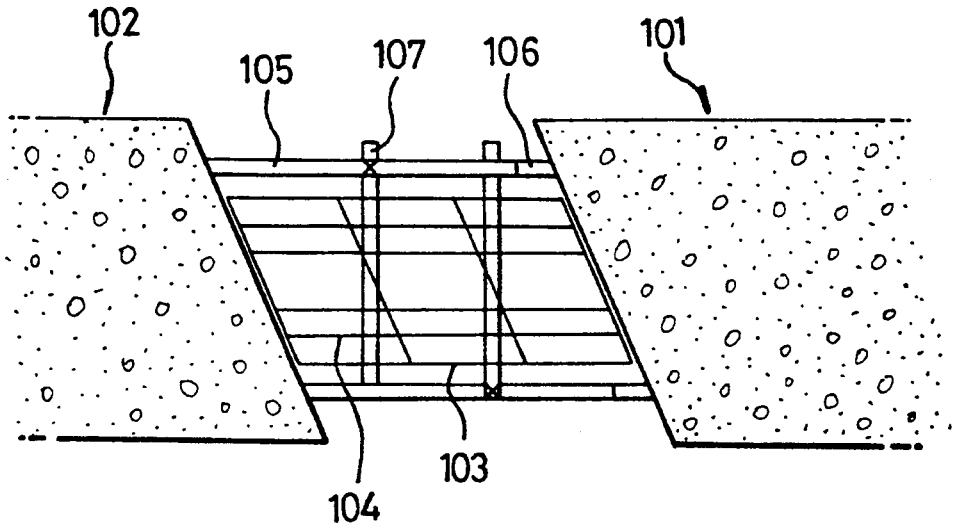

The present connection method is efficiently applied to connection of a precast concrete beam unit 1 to a precast concrete column unit 2, both units 1 and 2 having projecting reinforcing bars 6 and 5 at their ends. In addition, the present invention can be applied to connection of units and 102 which have the same appearance as that of the units 1 and 2 except for their inclined end surfaces as shown in FIGS. 13 to 15, to connection of precast concrete column units 2 as shown in FIGS. 7 and 8, to connection of a wall unit 17 to a slab unit 18 as shown in FIGS. 9 and 10, to connection of wall units 19 as shown in FIGS. 11 and 12, to connection of slab units (not shown) and to connection of column units 20 each of which has an upper end provided with upwar projecting reinforcing bars 22 and a lower end provided with sleeves 21 for receiving the upward projecting reinforcing bars 22 of another unit.

Figure 1:
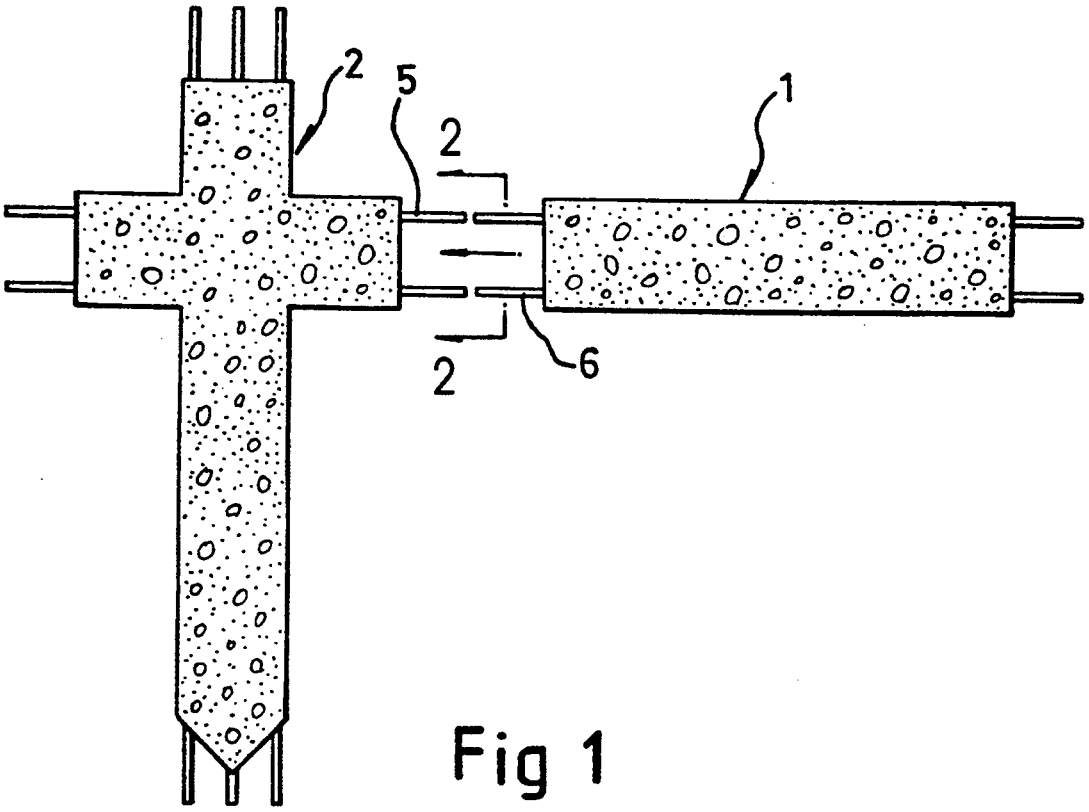
FIG. 1 is a schematic view showing the first step of an embodiment of a horizontal connection method, such as for connection of a beam unit to a column unit, in accordance with the present invention.
Figure 2:
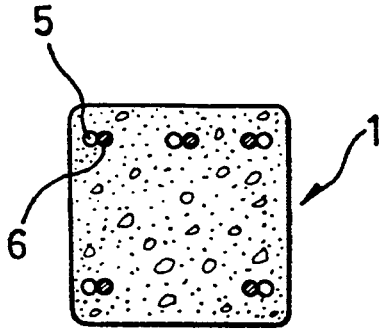
FIG. 2 is a cross sectioned view taken along the section line 2—2 of FIG. 1.
Figure 3:
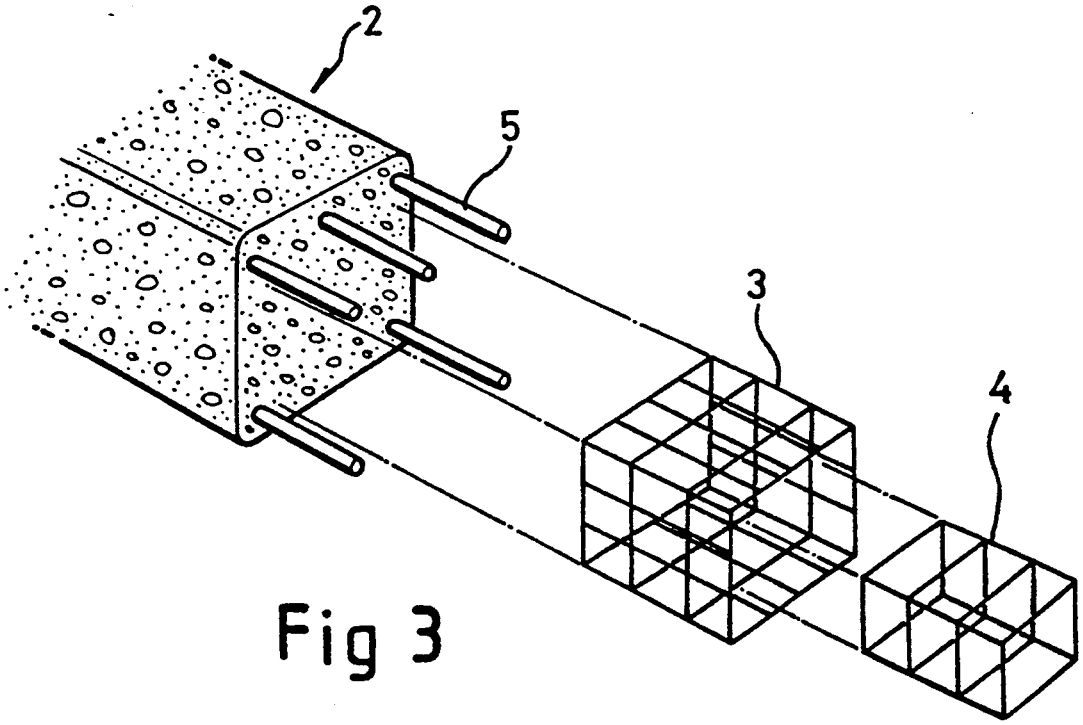
FIG. 3 is an exploded perspective view showing a state of a precast concrete beam unit of the present invention prior to being equipped at its end with wire nettings.

Particularly when a precast concrete beam unit is connected to a precast concrete column unit, for example, as shown in FIG. 1, it is preferred to make the connection part of the precast concrete units be located at a position, where the bending moment of the frame is smallest.

The conductive part of the connection part preferably comprises a first conductive member, that is an outer conductive member, directly connected to a terminal of the electric power source, a second conductive member directly connected to the other terminal of the same electric power source. Besides the two conductive members, the conductive part may further comprise at least one conductive member, for example, third, fourth and fifth conductive members. However, when the wall unit 17 is connected to the slab unit 18 as depicted in FIGS. 9 and 10 or when the pair of wall units 19 are connected to each other as depicted in FIGS. 11 and 12, one sheet-type wire netting 16 disposed in a space defined by the reinforcing bars 5 and 6 functions as an inner conductive member and another conductive members comprising projecting reinforcing bars 5 and 6 and temperature and shrinkage reinforcements 8 functions as two outer conductive members.

The following embodiments are merely intended to illustrate the present invention in further detail and should by no means be considered to limitative of the scope of the invention.

EMBODIMENT 1

This embodiment of a connection method is preferably applied to connection of precast concrete beam unit to a precast concrete column unit, preferably cross-type member, both units respectively having a plane end surface.

The two precast concrete units 1 and 2 shown in FIG. 1 are connected to each other through the following steps.

a) First step

The reinforcing bars projecting from both units are connected to each other, using conventional welding or mechanical connection method, with the second and third conductive members which comprise the wire nettings 3 and 4 of different sizes and are disposed in the space defined by the projecting reinforcing bars 5 and 6.

b) Second step

Figure 4:
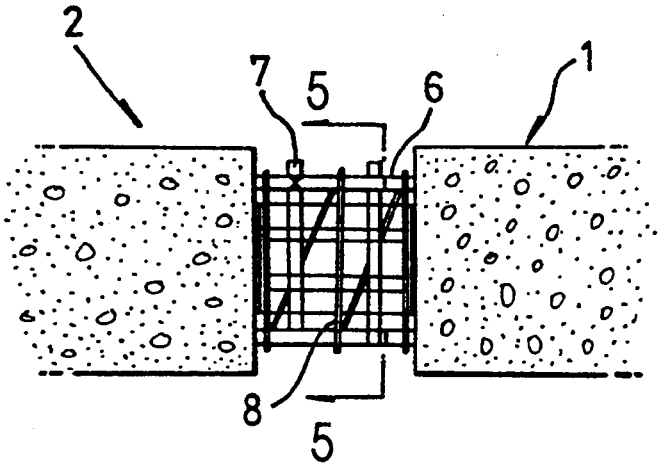
Figure 5:
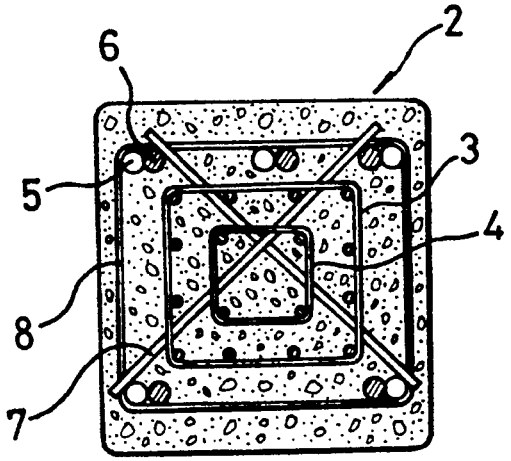

A stirrup 8 is wound around the connected reinforcing bars 5 and 6, as depicted in FIG. 4, in order to provide the first conductive member.

c) Third step

The second and third conductive members 3 and 4 are supported by a plurality of conventional short iron members projecting from end surfaces (not shown) and a plurality of nonconductive support rods 7 in order to maintain all the intervals between conductive members to be equal. Here, the short iron members and the nonconductive support rods 7 also function as fixing members for fixing the wire nettings 3 and 4 in their places.

d) Fourth step

Figure 6:
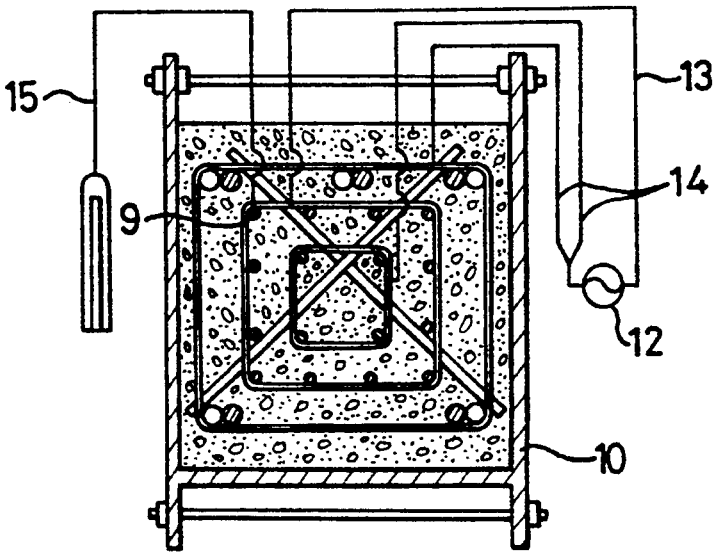
FIG. 6 is a cross sectioned view showing a state of the connection part prior to the last step of the present invention.

As depicted in FIG. 6, the first and third conductive members 8 and 4 are connected to a terminal of the electric power source 12, respectively, in order to form a first loop, while the second conductive member 3 is connected to the other terminal of the same electric power source 12 in order to form a second loop. In result, the first loop is provided at both the outside and inside of the second loop.

e) Fifth step

The connection part is surrounded by a form 10 (see FIG. 6) and concrete is placed into the form. Thereafter, electric power is supplied to the connection part and this makes the concrete between the respective conductive members 3, 4 and 8 of the connection part to be heated as it becomes an electric resistant material.

f) Sixth step

Concrete temperature is sensed by a sensor 9 (see FIG. 6) disposed at the second conductive member 3 in order to control the electric power supply in accordance with the sensed concrete temperature, thereby causing the concrete to be cured at a predetermined temperature.

EMBODIMENT 2

This embodiment is preferably applied to connection of the precast concrete wall unit 17 to the precast concrete slab unit 18 as depicted in FIGS. 9 and 10. In this embodiment, the steps are similar to those of the Embodiment 1 except for the following.

The projecting reinforcing bars 5 and 6 are connected to each other with the sheet-type wire netting 16 disposed in the space defined by the projecting reinforcing bars 5 and 6. The form 10 comprises a hopper-type form and the wall unit 17 has a center concentrated acute lower end in order to permit the concrete to be uniformly placed such that it is easily introducted to the center of the connection part. After the reinforcing bars 5 of the wall unit 17 are connected to the reinforcing bars 6 of the slab unit 18, the plurality of temperature and shrinkage reinforcements 8 are horizontally installed. In this case, conventional support means (not shown) is preferably used in order to support the wall unit 17 until the concrete placed in the connection part is sufficiently cured, thus, the connection of the wall unit 17 to the slab unit 18 is accomplished. Thereafter, the inner conductive member, the sheet-type wire netting 16, is connected to a terminal of the electric power source, while the outer conductive members including the reinforcing bars 5, 6 and 8 are connected to the other terminal of the same electric power source, respectively, thereby making it possible to electrically heat the concrete placed in the connection part.

EMBODIMENT 3

This embodiment is preferably applied to connection of the precast concrete wall units 19 to each other as depicted in FIGS. 11 and 12. In this embodiment, in similar to the Embodiment 2 conventional support means is preferably used in order to support the wall units 19 until the concrete placed in the connection part is sufficiently cured, thus, the connection of the wall units 19 is accomplished. Also the inner conductive member to be connected to a terminal of the electric power source comprises the sheet-type wire netting 16.

After the reinforcing bars 5 and 6 of the wall units 19 are connected to each other and the plurality of temperature and shrinkage reinforcements 8 are vertically installed, the other terminal of the electric power source is connected to the outer conductive member including the reinforcements 8. Thereafter, the form 10 is installed in order to surround the connection part and concrete is placed into the form. The concrete of the connection part is then electrically heated in the same manner as described in Embodiment 1.

In addition, this Embodiment can be applied to connection of precast concrete slab units to each other (not shown).

EMBODIMENT 4

This embodiment is preferably applied to connection of the precast concrete column units 2 to each other as depicted in FIGS. 7 and 8. In this embodiment, in similar to the Embodiment 2 conventional support means is preferably used in order to support the column units 2 until the concrete placed on the connection part is sufficiently cured. Also, the form 10 has the same shape as that of the embodiment 2.

EMBODIMENT 5

Figure 20:
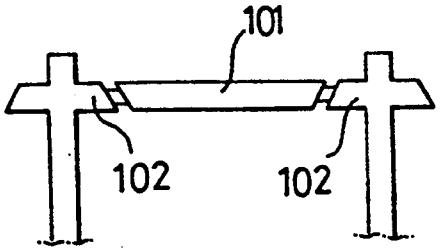
FIG. 20 is a schematic view showing the connection of the beam units to the column units in accordance with the embodiment of FIG. 13 to 15.
Figure 21:
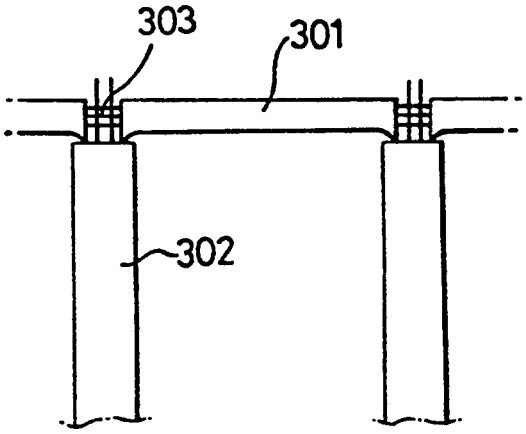
Fig 21 PRIOR ART
FIG. 21 is a schematic view showing an embodiment of a typical wet connection method for connecting precast concrete units (prior art)
Figure 22:
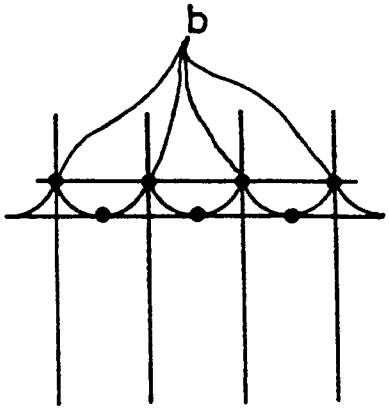
Fig 22 PRIOR ART
FIG. 22 (prior art) is a bending moment diagram of the frame of FIG. 21.

In this embodiment, the precast concrete units 101 and 102 are connected to each other in the same manner as that of the Embodiment 1. However, differently from the Embodiment 1, the concrete units 101 and 102 of the embodiment respectively have an inclined end surface in order to increase shearing strength of the connection part. Particularly, when the units 101 and 102 are connected to each other such that the connection parts are located in consideration of the bending moment distribution as depicted in FIG. 20, the structural behaviour of the frame is preferable.

EMBODIMENT 6

Figure 16:
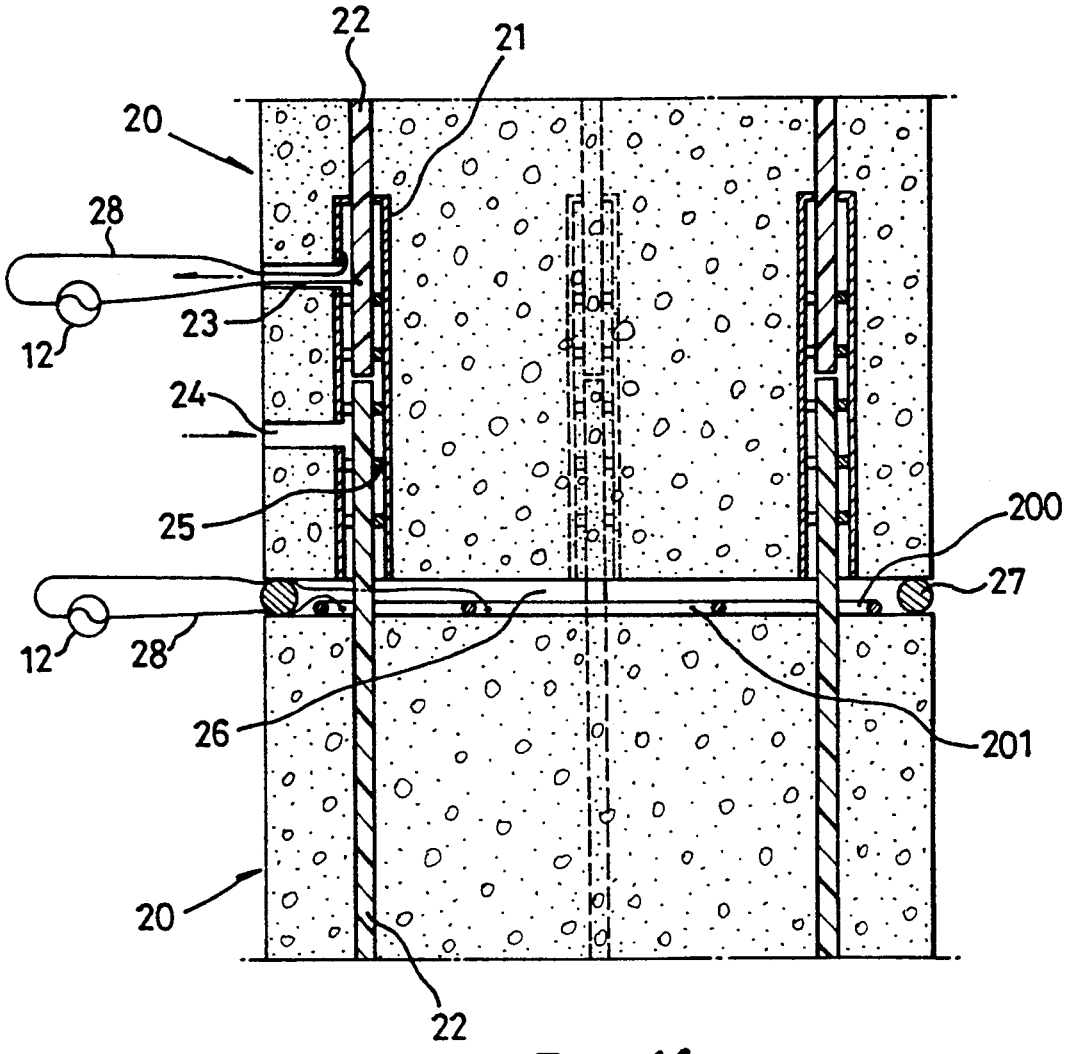
Figure 17:
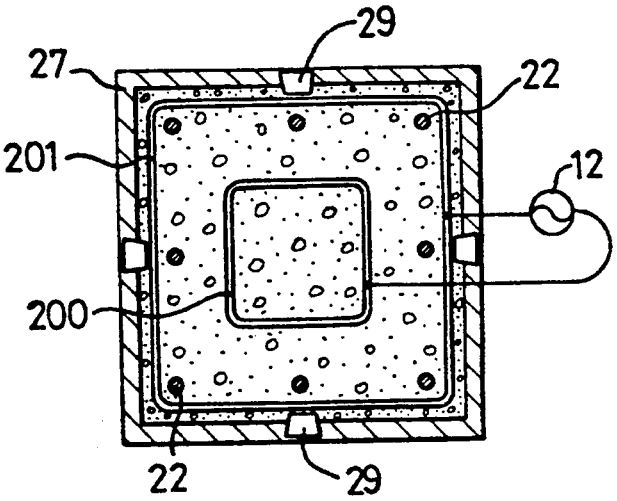
Figure 18:
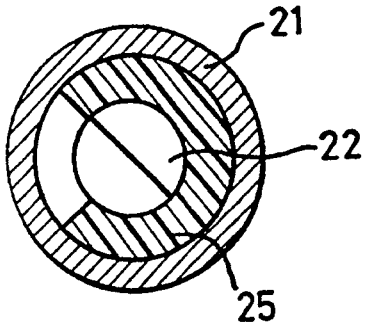
Figure 19:
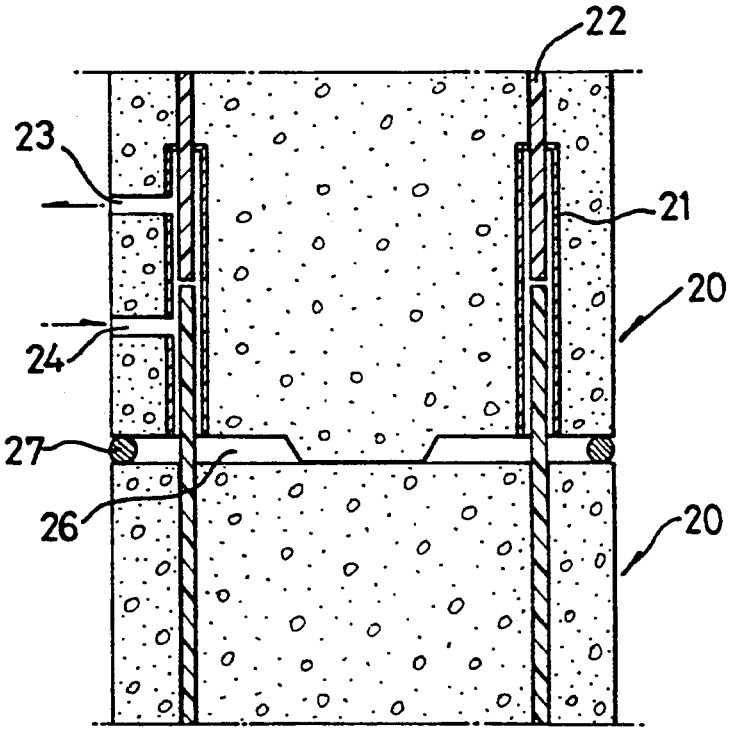
Fig 19 PRIOR ART
FIG. 19 is a view corresponding to FIG. 16, but showing the prior art.

This embodiment is preferably applied to connection of precast concrete column units 20, of which one is provided with upward projecting reinforcing bars 22 but the other is provided with sleeves 21 for receiving the reinforcing bars 22, to each other as shown in FIGS. 16 to 18. In this embodiment, one of the sleeves 21 is connected to a terminal of the electric power source 12, while one of the reinforcing bars 22, which is spaced apart from the sleeve 21 by a predetermined interval by means of a plurality of nonconductive spacers 25, is connected to the other terminal of the same electric power source 12. In addition, first and second conductive members 200 and 201, preferably comprising metal wires, are provided in a grouting space 26, which is provided between the two units 20 by virtue of a plurality of support plates 29 made of thermoplastic resin, and connected to both terminals of another electric power source 12. The grouting space 26 is then sealed with a sealing member 27. Thereafter, conventional grouting is carried out, in other words, grout or mortar is pumped through a grouting inlet 24 in order to be introduced into both the inner space of the sleeves 21 and the space between the units 20 until it comes out through an outlet hole 23. Electric power is supplied to the conductive members 21, 22, 200 and 201 and this causes the temperature of the grout or mortar to rise so as to shorten the curing period and soften the thermoplastic support plates 29 and the grout or mortar to support the weight of the upper column unit 20. In this respect, it is possible to accomplish a desired strong connection of the column units 20.

As described above, the present invention provides a method for connection of precast concrete units to each other in which concrete placed in the connection part at which the units are connected to each other is electrically heated, thereby causing the concrete to be cured in a shorter time than the known wet connection method, thus shortening the term of work.

The present invention has been described in detail with particular reference to preferred embodiments thereof, but it will be understood that variations and modifications can be effected within the spirit and scope of the invention.

What is claimed is:

1. A method for connecting precast concrete units to each other comprising the steps of:

a) facing ends of said concrete units to be connected toward each other, providing a conductive wire or net means in the space defined by a plurality of reinforcing bars projecting from the ends of said units and connecting said reinforcing bars mechanically;

b) winding at least one conductive linear member around said connected reinforcing bars;

c) supporting said conductive wire or net means to said reinforcing bars by using at least one embedded and nonconductive support means so that said conductive wire or net means is positioned in said space, and forming an electric loop by connecting a first terminal of an electric power source to said conductive wire or net means, and a second terminal of said electric power source to said conductive linear member and/or said reinforcing bars; and d) installing a form around said conductive linear member in order to surround said conductive linear member with a uniform space between said form and said conductive linear member, placing concrete into said form in order to fill the space defined by said form and said mechanically connected reinforcing bars with said concrete, and applying electric power to said conductive members in order to cause said concrete to be heated.

2. A method for connecting precast concrete units in accordance with claim 1, wherein said units are wall-type units.

3. A method for connecting precast concrete units in accordance with claim 1, wherein said units are beam-type units.

4. A method for connecting precast concrete units in accordance with claim 1, wherein at least one of said units is a wall-type unit and at least one of said units is a slab-type unit.

5. A method for connecting precast concrete units in accordance with claim 1, wherein said units are slab-type units.

6. A method for connecting precast concrete units in accordance with claim 1, wherein said units are column-type units, wherein each of said column-type units is provided at a first upper end with at least one upward projecting reinforcing bar and is further provided at a second lower end with at least one sleeve into which the lower end of said reinforcing bar downwardly extends, said sleeve being adapted to receive an upward projecting reinforcing bar of another of said column-type units when said column-type units are connected to each other.

7. A method for connecting precast concrete units in accordance with claim 6, wherein said reinforcing bar received in said sleeve is spaced, using a plurality of nonconductive spacers, apart from the inner surface of said sleeve with a uniform interval therebetween and said sleeve and said received reinforcement bar are connected to said first and second terminals of said electric power source to form an electric loop, and said column-type units are further provided with a grouting space therebetween said column-type units by means of a plurality of support plates, said grouting space being sealed with a sealing member.

8. A method for connecting precast concrete units in accordance with claim 7, wherein each of said support plate are made of thermoplastic resin.

9. A method for connecting precast concrete units in accordance with claim 1, wherein each of said units has an inclined end surface.

10. A method for connecting precast concrete units in accordance with claim 1, wherein each of said units is a column-type or wall-type unit whose lower end is center concentrated acute.

11. A method for connecting precast concrete units in accordance with claim 1, wherein said conductive wire or net means is provided with a temperature sensor for sensing the heating temperature of the placed concrete.

12. A method for connecting precast concrete units in accordance with claim 2, wherein said conductive wire or net means is provided with a temperature sensor for sensing the heating temperature of the placed concrete.

13. A method for connecting precast concrete units in accordance with claim 3, wherein said conductive wire or net means is provided with a temperature sensor for sensing the heating temperature of the placed concrete.

14. A method for connecting precast concrete units in accordance with claim 4, wherein said conductive wire or net means is provided with a temperature sensor for sensing the heating temperature of the placed concrete.

15. A method for connecting precast concrete units in accordance with claim 5, wherein said conductive wire or net means is provided with a temperature sensor for sensing the heating temperature of the placed concrete.

16. A method for connecting precast concrete units in accordance with claim 6, wherein said conductive wire or net means is provided with a temperature sensor for sensing the heating temperature of the placed concrete.

17. A method for connecting precast concrete units in accordance with claim 7, wherein said conductive wire or net means is provided with a temperature sensor for sensing the heating temperature of the placed concrete.

18. A method for connecting precast concrete units in accordance with claim 8, wherein said conductive wire or net means is provided with a temperature sensor for sensing the heating temperature of the placed concrete.

19. A method for connecting precast concrete units in accordance with claim 9, wherein said conductive wire or net means is provided with a temperature sensor for sensing the heating temperature of the placed concrete.

20. A method for connecting precast concrete units in accordance with claim 10, wherein said conductive wire or net means is provided with a temperature sensor for sensing the heating temperature of the placed concrete.

21. A method for connecting precast concrete units in accordance with claim 1, wherein said conductive wire or net means includes conductive objects with openings through which fresh concrete can pass easily.

22. A method for connecting precast concrete units in accordance with claim 21, wherein said conductive objects are selected from the group consisting of woven steel net, steel wire mesh or expanded metal.

* * * * *